United States Patent [19]

Nonaka et al.

[11] Patent Number: 4,910,546

[45] Date of Patent: Mar. 20, 1990

[54] FILM PROCESSING DEVICE

[75] Inventors: Osamu Nonaka, Tokyo; Hiroshi Matsuoka, Ayase; Tatsuya Emoto, Ayase; Mutsumi Ashizawa, Ayase; Akinobu Agatsuma, Ayase, all of Japan

[73] Assignee: Fuji Photo Film Co., Ltd., Kanagawa, Japan

[21] Appl. No.: 341,505

[22] Filed: Apr. 21, 1989

[30] Foreign Application Priority Data

| | | | |
|---|---|---|---|
| Apr. 27, 1988 | [JP] | Japan | 63-102641 |
| Apr. 27, 1988 | [JP] | Japan | 63-102646 |
| May 16, 1988 | [JP] | Japan | 63-117050 |
| Aug. 16, 1988 | [JP] | Japan | 63-202753 |

[51] Int. Cl.[4] ..... G03D 3/04; G03D 3/13

[52] U.S. Cl. ..... 354/299; 354/321; 354/322; 354/328

[58] Field of Search ..... 354/316, 320, 321, 322, 354/328, 299

[56] References Cited

U.S. PATENT DOCUMENTS

| | | | |
|---|---|---|---|
| 3,383,996 | 5/1968 | Dokulil et al. | 354/299 |
| 4,099,193 | 7/1978 | Leuchter et al. | 354/321 |
| 4,780,737 | 10/1988 | Kobayashi et al. | 354/322 |

*Primary Examiner*—A. A. Mathews

*Attorney, Agent, or Firm*—Sughrue, Mion, Zinn, Macpeak & Seas

[57] ABSTRACT

A film processing device contains a film feed unit, a film developing unit, a film drying unit, and a film winding unit. The drying unit and the winding unit are integrally structured, and the feed unit, developing unit, and the drying/winding unit are independently arranged in the casing and are independently detachable. The film processing device can be further provided with an upper cover having processing rollers attached thereto, which is vertically movable with respect to the casing so that the rollers are dipped into the developing and washing liquids when the upper cover is lowered.

7 Claims, 12 Drawing Sheets

FILM PROCESSING DEVICE

BACKGROUND OF THE INVENTION

This invention relates to a portable film processing device that develops a film such as a microfilm.

In general, microfilm is used to positively record and store large amounts of documents and to enable retrieving and checking of the recorded documents as needed. In this case, documents are photographed in reduced sizes on the microfilm and, when the contents are checked, the microfilm is enlarge-projected or enlarge-copied, for example, using a micro-reader.

Microfilm which is used in this way must be processed for developing before storage. Specifically, a photographed microfilm is processed sequentially using a developing solution a fixing solution, a cleaning solution, and the like, wiped to remove remaining solution, and then dried. Processing devices have been developed that perform such procedures automatically. In such automatic processing devices, it is effective to raise the temperature of the developing solution in order to accelerate the reaction, and it is further effective to stir the developing solution in order to achieve uniform heating.

However, since film processing devices previously used have been large in size, they have been impossible to carry, for example, for use in developing films in remote places. Therefore, a compact, portable film processing device has been in demand.

Such a compact film processing device must contain functions similar to those of large-sized devices in a small space, which can pose problems. In particular, when these functions are located dispersively in the device, assembly work of the device becomes complicated, and maintenance and replacement of parts becomes inconvenient.

SUMMARY OF THE INVENTION

In order to eliminate such problems with prior art film processing devices, it is a primary object of the present invention to provide a portable film processing device which contains various functions necessary for film processing, effectively and independently arranged within a small space and which enables simple developing and processing work on films.

In accordance with the present invention which attains the above object, a first film processing device is provided which comprises a feed unit containing a feed reel around which undeveloped film in a light-shielded state is wound, a developing unit for storing and stirring a heated developing solution, a fixing solution, and washing liquids and for feeding the film into the solutions and liquids using a plurality of rollers.

a drying unit for drying the film by blowing hot air from a hot air blowing port, and a winding unit for winding the dried film around a winding reel which is disposed beneath the hot air blowing port of the drying unit, and wherein the drying unit and the winding unit are an integrally structured unit and the feed unit, the developing unit, and the drying/winding unit are separately assembled and installed.

According to the present invention, a second film processing device i also provided which comprises a feed unit or containing a feed reel around which undeveloped film in a light-shielded state is wound.

a developing unit having a processing solution tank containing at least a developing solution a fixing solution, and a washing liquid in order, at least three processing rollers immersed respectively in the developing solution, the fixing solution, and the washing liquid, and at least two direction-changing rollers disposed above the processing solution tank and between adjacent processing rollers for routing up and down n exposed film in alternation over the processing rollers, the developing unit having a casing which allows easy insertion and detachment, a drying unit for drying the film by blowing hot air, a winding unit for winding the dried film on a winding reel;

an upper cover attached to and vertically movable with respect to the casing, and a roller rack protruding downward from the upper cover and having the processing rollers rotatably attached to its bottom end, wherein the upper cover may be adjusted so that the processing rollers are positioned above the direction changing rollers.

BRIEF DESCRIPTION OF THE DRAWINGS

These and other objects as well as advantages of the present invention will become clear by the following description of preferred embodiments of the present invention with reference to the accompanying drawings wherein.

DETAILED DESCRIPTION OF THE PREFERRED EMBODIMENTS

A first preferred embodiment of the present invention will now be described in detail with reference to the drawings.

Figure 1:
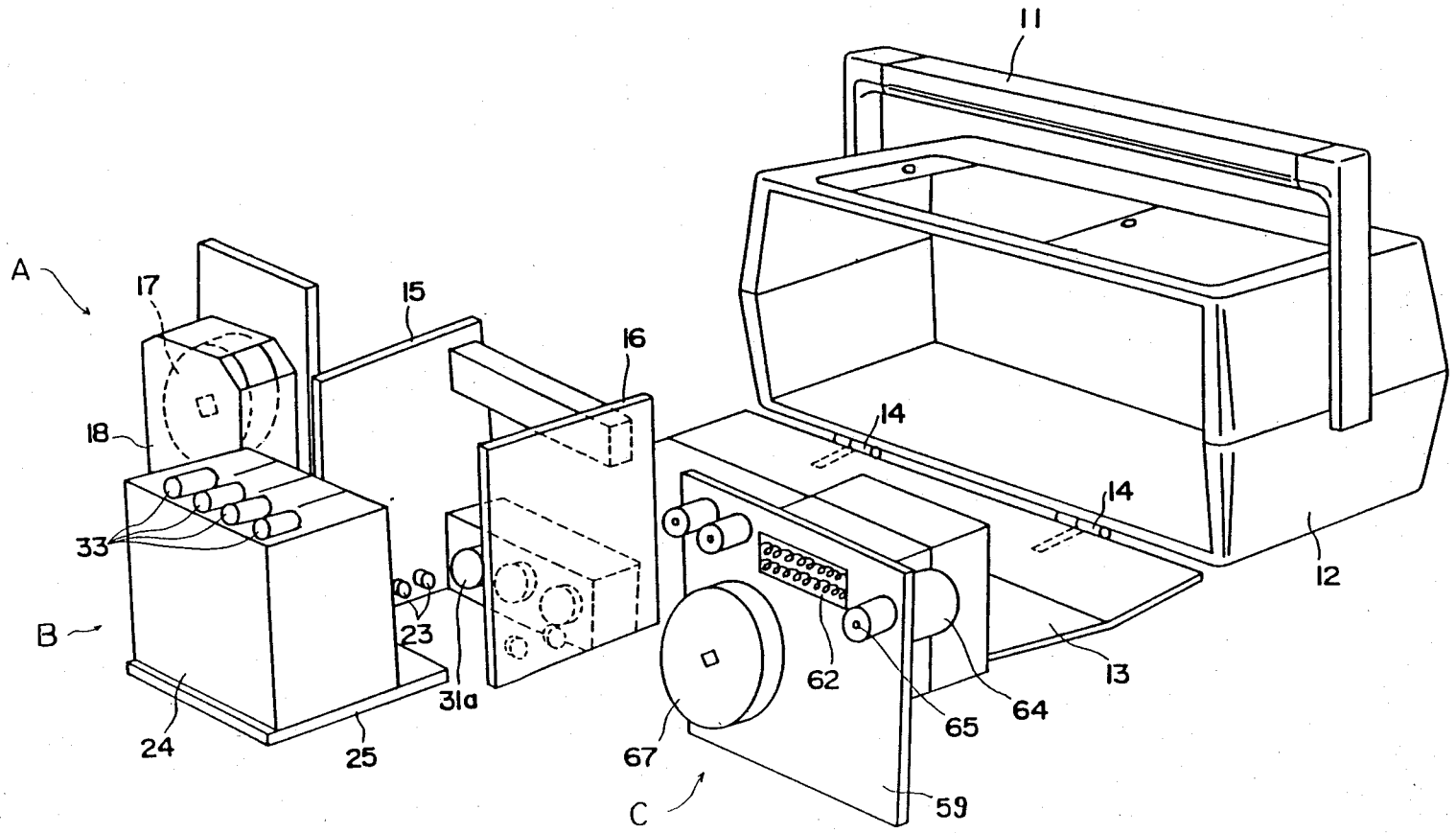
FIG. 1 is a schematic disassembled view of a first embodiment of the film processing device according to the present invention.

FIGS. 1 to 6 are schematic views showing the first embodiment. Referring to these figures, a front cover 13 is provided on the front surface of a casing 12, which has a rotatably mounted carrying handle 11. Front cover 13 is supported by a hinge 14 which allows the cover to open towards the front. The casing 12 is further provided with partition frames 15 and 16 to partition the casing 12 into three parts: a feed unit A, a processing unit B. an a drying/winding unit C. Feed unit A, processing unit B. and drying/winding unit C are assembled independently and, as shown in FIG. 1, can be detached from casing 12. Feed unit A. which is located on the left of partition frame 15, includes a light shielding case 18 which contains a feed reel 17 and is attached to a mounting plate 81. A pair of reel supporting rollers 19 for rotatably supporting feed reel 17 are rotatably mounted in light shielding case 18. An exposed film 20 is wound around feed reel 17. Feed unit A is fixed by fastening mounting plate 81 to casing 12 with bolts or the like and, when the bolts are removed, can be removed as a single unit from casing 12. An opening in light shielding case 18 for unreeling film 20 is provided with a photoelectric film sensor 22 for detecting the presence of film 20.

A processing solution tank 24 is detachably provided in processing unit B. which is located between partition frames 15 and 16. Two pairs of front and rear receiving tray guide rollers 23 are rotatably mounted on the opposing surfaces of partition frames 15 and 16. A receiving tray 25 is detachably placed on receiving tray guide rollers 23. The processing solution tank 24 is detachably placed on the receiving tray 25.

The inside of processing solution tank 24 is divided into four sections by three partition walls 26. The four sections of tank 24 respectively contain a developing solution 27, a fixing solution 28, a first washing liquid 29, and second washing liquid 30. In the first embodiment, the sections of the processing solution tank 24 containing developing solution 27 and washing liquids 29 and 30 are rotatably provided with stirring impellers 32 which are rotated by magnetic stirrers 31*a*, 31*b*, and 31*c*, which will be described later herein, to stir developing solution 27 and washing liquids 29 and 30, respectively. In this case, the section of tank 24 containing fixing solution 28 may also be provided with a stirring impeller 32. Thus, stirring impellers 32 can be provided in all sections that require stirring. On top of processing solution tank 24 are supported front and rear ends of supporting shafts 34 for rotatably supporting four direction-changing rollers 33.

A beam 35, of which right and left ends are connected to partition frames 15 and 16, is disposed at the rear of processing solution tank 24 which has been placed on receiving tray 25. On beam 35, at the front end of a swing holder 37 which is rotatably disposed through a hinge 36, a rod-shaped developing heater 38 for heating developing solution 27, a liquid temperature sensor 39 for detecting the temperature of developing solution 27, and a liquid level sensor 40 which electrically detects whether or not the surface of developing solution 27 is above a predetermined level respectively project downward. At the rear end of swing holder 37 is connected one end of a spring 41 which has a spring force to move up the front end of swing holder 37 about hinge 36 and to withdraw developing heater 38, liquid temperature sensor 39, and liquid level sensor 40 with respect to the processing solution tank 24, and the other end of spring 41 is fixed to beam 35. Furthermore, a contact plate 42, comprising a plate spring, for which the front end is in contact against the rear end of the processing solution tank 24 on the receiving tray 25 to turn the front end of swing holder 37 to the front around hinge 36 and to dip developing heater 38, liquid temperature sensor 39, and the lower portion of liquid level sensor 40 in developing solution 27, is connected to swing holder 37 so that its rear end is positioned at the rear side of hinge 36.

Figure 3:
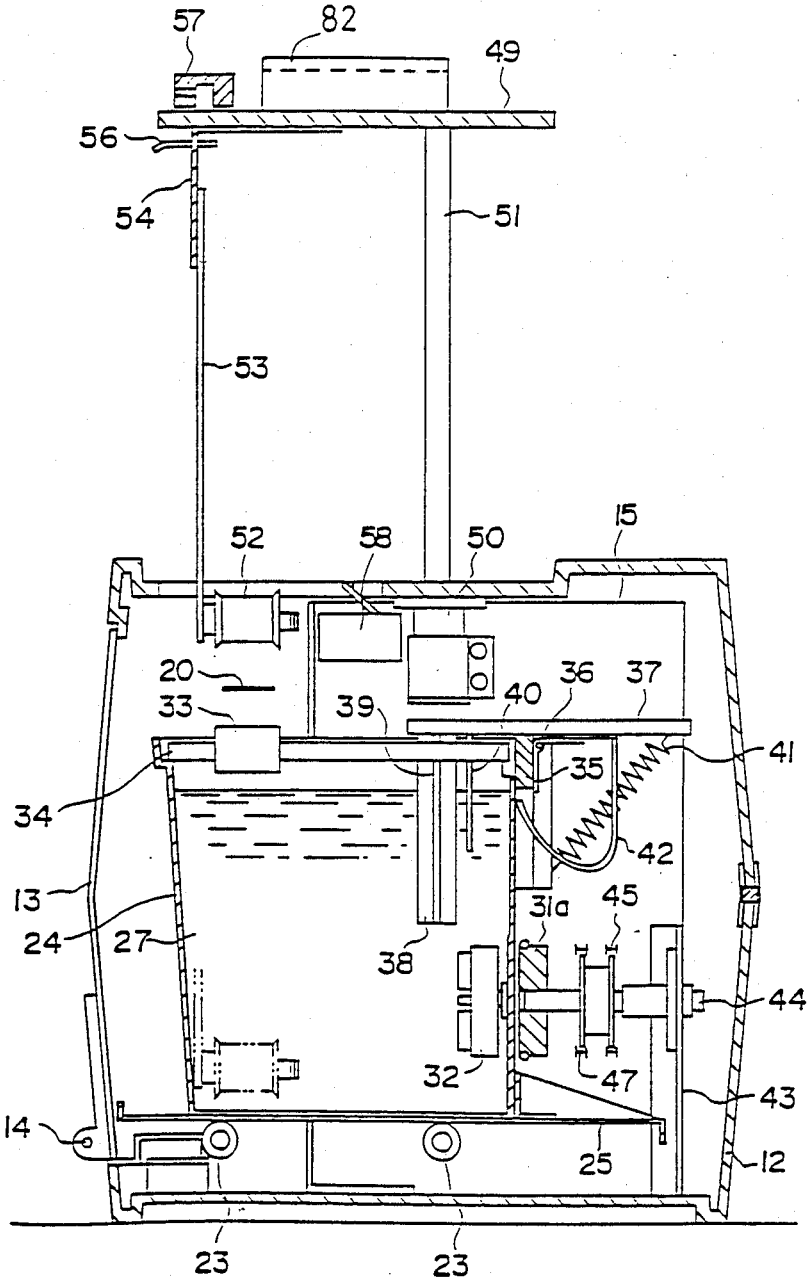
FIG. 3 is a schematic sectional view taken along line III—III of FIG. 2.

The spring force of contact plate 42 is set to a level greater than that of spring 41 in the state as shown in FIG. 3. Therefore, when the processing solution tank 24 is pressed against contact plate 42, the front side of swing holder 37 is pushed down by contact plate 42 but, when he processing solution tank 24 is pulled to the front by receiving tray 25, the front end of contact plate 42 is set free and the front side of swing holder 37 is moved up by the force of spring 41.

The three magnetic stirrers 31*a* to 31*c*, which respectively are disposed in the vicinity of the processing solution tank 24 and opposite to the stirring impellers 32 at the inside rear of casing 12, are rotatably supported through supporting shafts 44 by a stirrer supporting beam 43 disposed between the partition frames 15 and 16. An endless chain 45 is provided between the supporting shaft 44 of magnetic stirrer 31*a* for developing solution 27 and the supporting shaft 44 of magnetic stirrer 31*c* for second washing liquid 30, and an endless driving chain 47 is provided between the supporting shaft 44 of magnetic stirrer 31*a* for developing solution 27 and a sprocket (not shown) for a stirring motor 46. Therefore, when the stirring motor 46 is operated, a drive force is transmitted via chains 45 and 47 to rotate magnetic stirrers 31*a* to 31*c* in the same direction and, in turn, the stirring impellers 32 incorporated in the processing solution tank 24 are rotated by a magnetic force to stir developing solution 27 and washing liquids 29 and 30

The thus structured processing unit B is mounted by fastening the partition frames 15 and 16 to the casing 12 with bolts or the like and, when these bolts are loosened, processing unit B can be removed integrally with partition frames 15 and 16 as shown in FIG. 1.

An upwardly openable upper cover 49 is provided on top of casing 12. Upper cover 49 is provided projectingly downward with a pair of guide bars 51, which are slidable and penetrate vertically with friction through a pair of fixed guide tubes 50 through partition frames 15 and 16 at the top end of casing 12. Thus, upper cover 49 may be moved vertically along guide bars 51. At the front side of upper cover 49, a roller rack 53 is provided with processing rollers 52 rotatably attached to its bottom which respectively are immersed in developing solution 27 and washing liquids 29 and 30. Roller rack 53 protrudes downward through a rack bracket 54 and is provided with vertical notches 55 formed at three positions to prevent interaction between the processing solution tank 24 and the partition walls 26. On both sides of rack brackets 54, a pair of locking knobs 57 each having a locking claw 56 to retain the upper cover 49 onto the casing 12 when upper cover 49 is moved down are rotatably attached to upper cover 49. A touch sensor 58 mounted on top of casing 12 detects whether or not upper cover 49 is securely retained on casing 12.

Figure 4:
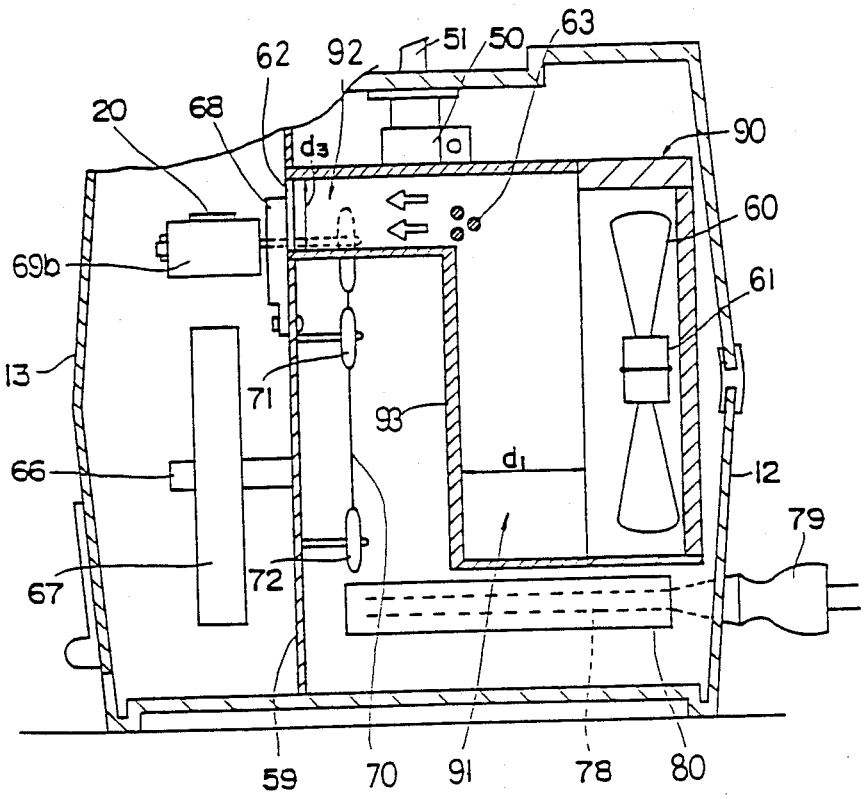
FIG. 4 is a schematic sectional view taken along line IV—IV of FIG. 2.
Figure 5:
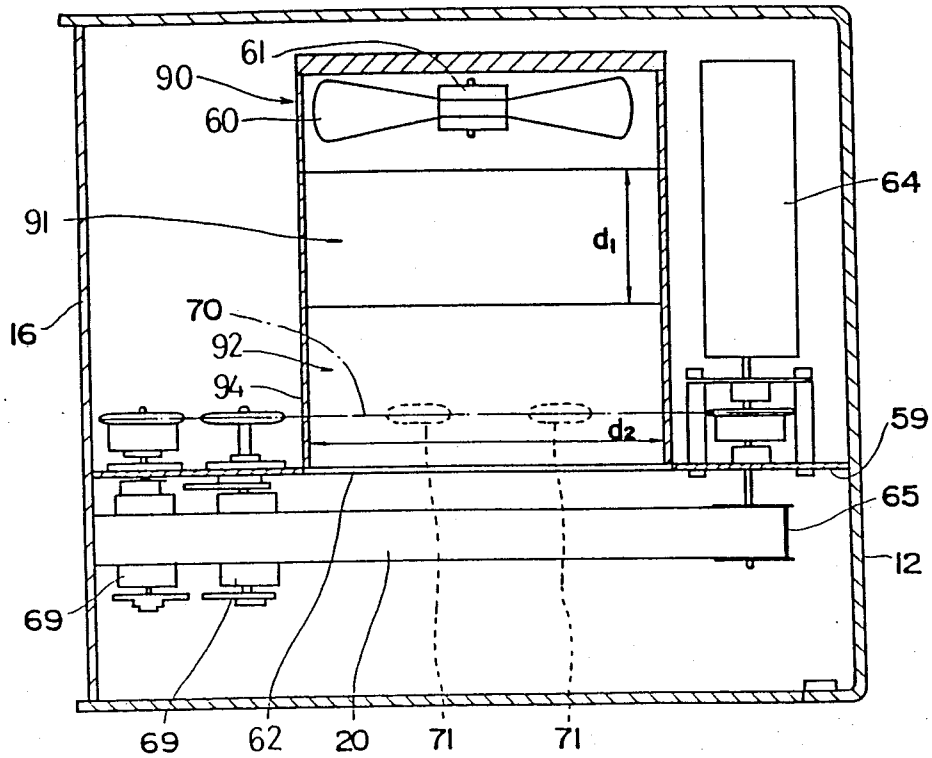
FIG. 5 is a schematic sectional view taken aong line V—V of FIG. 2.

The drying/winding unit C disposed at the right side of partition frame 16 is provided with a partition wall 59 which partitions this section into front and rear portions. As shown in FIG. 4 and FIG. 5, a fan motor 61 having a blowing fan 60 to dry processed film 20 is disposed on the rear side of partition wall 59. Air blown from blowing fan 0 by fan motor 61 passes through a buffer chamber 91 and a blowing chamber 92 and is blown from a hot air blowing port 62 formed in partition wall 59 in a direction parallel to the surface of film 20. A drying heater 63 is provided at the point where buffer chamber 91 and blowing chamber 92 are connected to shorten the drying time.

Buffer chamber 91 temporarily stores the blown air. The thickness ($d_1$) of buffer chamber 91 is preferably the same as or greater than the thickness of blowing fan 60 with a maximum thickness of about 2.5 times that of blowing fan 60. If the thickness $d_1$ of buffer chamber 91 is smaller, air blowing against a front wall 93 of buffer chamber 91 flows back towards the blowing fan 60, and proper air flow rate and wind pressure cannot be obtained. If the thickness $d_1$ is excessively great, a greater part of the air is stored in buffer chamber 91, and proper air flow rate and wind pressure cannot be obtained. Blowing chamber 92 may be provided at part of a periphery of buffer chamber 91 along the film feed direction. Dimensions of the opening of blowing chamber 92 are preferably such that its horizontal width $d_2$ along the film feed direction is almost the same as the diameter of blowing fan 60. The height $d_3$ of hot air blowing port 62 is 1/5 to 1/6 the diameter of blowing fan 00. This is because, if the height $d_3$ is too small, although the wind pressure becomes high, a high air flow rate cannot be obtained. If it is too great, although the air flow rate becomes high, a high wind pressure cannot be obtained.

When blowing fan 60 is driven by fan motor 61, wind is temporarily stored n buffer chamber 91 disposed at the front, and then uniformly flows to hot air blowing prot 62 of blowing chamber 92 which is disposed above the front wall 93 of buffer chamber 91. At this moment, wind is straightened in the direction parallel to a side wall 94 of blowing chamber 92 and then blown in a constant direction from hot air blowing port 62. Since hot air blowing port as described above, has a large horizontal width $d_2$ in the film feed direction and a small height, a sufficient wind pressure and the above-mentioned uniform air flow rate can be obtained. This allows efficient drying of film 20 as it is fed, and enables a compact drying process.

In this embodiment, blowing fan 60, fan motor 61, hot air blow port 62, drying heater 63, and other components comprise a drying device.

Figure 2:
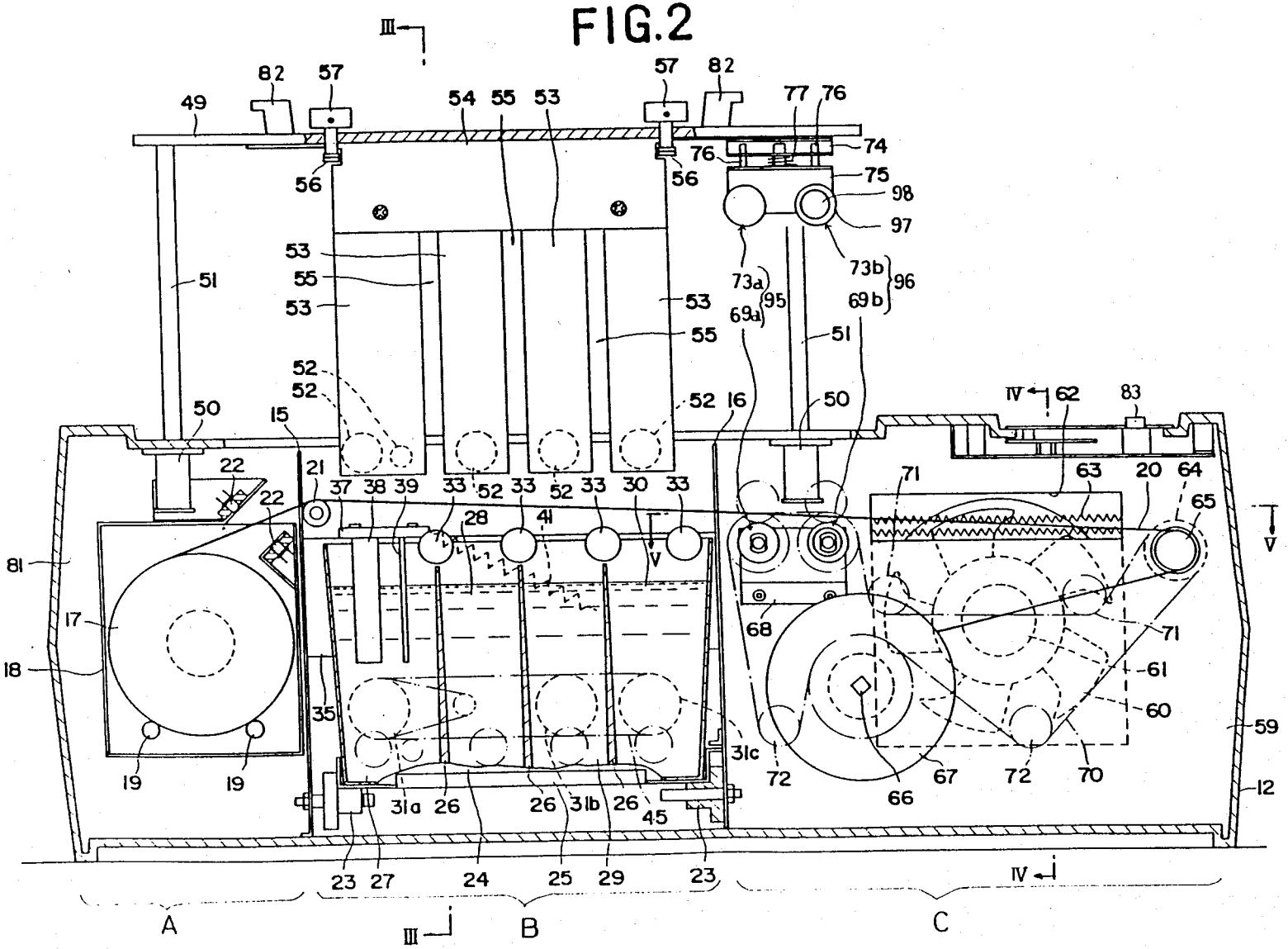
FIG. 2 is a schematic view showing internal structure of the film processing, device shown in FIG. 1.

Referring to FIG. 2, a film drive roller 65 connected to a film feed motor 64 is rotatably mounted at the upper right end of partition wall 59. Similarly, a winding shaft 6 is rotatably provided at the lower left end of partition wall 59 disposed below hot air blowing port 62, and a winding reel 67 for winding the dried film 20 is detachably mounted on winding shaft 66.

Two fixed squeeze rollers (right and left) 69 attached rotatably to partition wall 59 are disposed above winding shaft 66 by a bracket 68. An endless synchronizing chain 70 is provided on fixed squeeze rollers 69, winding shaft 66, and film drive roller 65. Furthermore, in this embodiment, a pair or withdrawing sprockets 71 are disposed between fixed squeeze rollers 69 and film drive roller 65 and winding sprockets 72 are disposed at the right and left of winding shaft 66. Withdrawing sprockets 71 and winding sprockets 72 are rotatably attached to partition wall 59 and engage With synchronizing chain 70. Film drive motor 64 rotates fixed squeeze rollers 69, film drive roller 65, and winding shaft 66 in synchronization. Since film drive roller 65 is disposed opposite to fixed squeeze rollers 69 with respect to hot air blowing port 62, it acts as a reversing means to guide the film 20 to winding reel 67.

These drive mechanisms are all dispose at the rear side of partition wall 59. A drying/winding unit C with such an arrangement is retained by fastening partition wall 59 on casing 12 using bolts. The bolts can be loosened to allow unit C to be removed as an integral unit as shown in FIG. 1.

Right and left holding squeeze rollers 73 (73*a* and 73*b* ) cooperate with fixed squeeze rollers 69*a* and 69*b* to wipe off water drops from processed film 20. Holding squeeze rollers 73 are rotatably supported on a roller holder 75 which hangs own from upper cover 49 through a roller bracket 74. Stopping pins 76 hold the rotational axes of fixed squeeze rollers 69*a* and 69*b* parallel to the rotational axes of holding squeeze rollers 73*a* and 73*b*. A pressing spring 77 forces holding squeeze rollers 73 towards fixed squeeze rollers 69. Stopping pins 76 and pressing spring 77 are disposed between roller bracket 74 and roller holder 75.

The upstream side pair of squeeze rollers 69*a* and 73*a* are water-repellent squeeze rollers 95 with high water-repellent properties. The downstream pair of squeeze rollers 69*b* and 73*b* are hydrophilic rollers 96 which absorb water. Water-repellent squeeze rollers 95 ar made of a highly water-repellent material such as silicon resin or phenolic resin, molded integrally. Hydrophilic squeeze rollers 96 comprise a highly hydrophilic artificial leather material 97 such as Excene (brand name Toray Industries. Inc.). coated on the outer surface of a plastic or metal roll 98. Since the Excene used in this embodiment is a single layer material comprising very fine, entangled fibers (0.01 to 0.09 deniers) such as seen in natural leather, it has adequate elasticity and water absorption properties.

Squeeze roller 95 and 96 are made of different materials and are disposed between the developing and the drying stages of the process. The wet film 20 is squeezed by upstream water-repellent squeeze rollers 95 to remove most of the water and is wiped by downstream hydrophilic squeeze rollers 96 to completely remove residual water.

This embodiment uses two pairs of squeeze rollers. However, the present invention is not restricted to the above arrangement but, alternatively, a plurality of rollers may be used, provided that there is at least a combination of water-repellent squeeze rollers disposed at the upstream side of hydrophilic squeeze rollers.

As described above, in the film processing device according to the present invention, after the developing process in which film 20 was washed in washing liquids 29 and 30 (e.g., water) is passed between the two sets of squeeze rollers 95 and 96. Rollers 95 and 96 are made of different materials and are disposed at two positions in the film feed direction to remove water to some extent. Then film 20 is fed to the drying process with its surface held substantially horizontally.

Downstream from squeeze rollers 95 and 96, hot air blowing port 62 of the drying device is disposed along film so that the center lines in the moving directions of film 20 and hot air blowing port 62 are perpendicular to each other. Therefore, hot air blown out of hot air blowing port 62 is blown onto both sides of film 20 substantially parallel to the surface of the film 20. Thus, drying is performed by blowing the wind at a uniform flow rate wit good directivity and a high pressure obtained by the film drying device. The hot air is blown along both surfaces of film 20 from its side so that efficient and complete drying is achieved using a minimal space.

In this embodiment, dried film 20 is reversed and fed towards the lower left by film drive roller 65, and is rolled on winding reel 67 disposed at the lower left of hot air blowing port 62. Thus, the front portion of partition wall 59 is used as a chamber for both drying and film winding. By performing both the drying and winding steps in the chamber, compact design is achieved compared to the prior art devices in which these steps are performed separately and require a large space, and the film 20 wound around winding reel 67 is always kept dry.

In actual operation, the entire device is first placed on a table or the like, a power cord 78 wound around a cord reel 80 is unrolled, and a plug 79 at the end of power cord 78 is connected to a power outlet in the room.

The front cover is opened and locking knobs 57 are turned to unlock locking claws 56 from casing 12. Processing rollers 52 and upper cover 49 are then lifted up to a location above the processing solution tank 24 by gripping a handle 82 provided on upper cover 49 (FIG. 2 and FIG. 3). Then the processing solution tank 24 together with the receiving tray 25 is pulled out to the front. At this time, in the course of pulling out the receiving tray, the front end of contact plate 42 becomes free, and swing holder 37 is turned about hinge 36 by the force of spring 41 to withdraw developing heater 38, liquid temperature sensor 39, and liquid level sensor 40 to a location above the processing solution tank 24. Predetermined sections of the processing solution tank 24, which has been pulled out to the front of casing 12, are respectively charged with predetermined quantities of developing solution 27, fixing solution 28, and washing liquids 29 an 30, and the processing solution tank 24 together with the receiving tray 25 are then returned to their original position in the casing 12. At this time, the front end of contact plate 42 comes into contact with the processing solution tank 24, swing holder 37 is turned against the force of spring 41, and developing heater 38, liquid temperature sensor 39, and liquid level sensor 40 are dipped in the developing solution 27 (FIG. 2 and FIG. 3)

Next, a cover (not shown) of light shielding case 18 is opened and feed reel 17 having developed film 20 wound around it, is placed on reel receiving roller 19 and the cover of light shielding case 18 is closed with the leader portion of film 20 unrolled. The front end of the leader of film 20 is routed from fixed guide roller 21, over through the processing solution tank 24 and fixed squeeze rollers **69*a* and 99*b* and through the front of hot air blowing port 62, wound around film drive roller 65, and fixed to winding reel 67 which is mounted on winding shaft 66** (FIG. 2).

Figure 6:
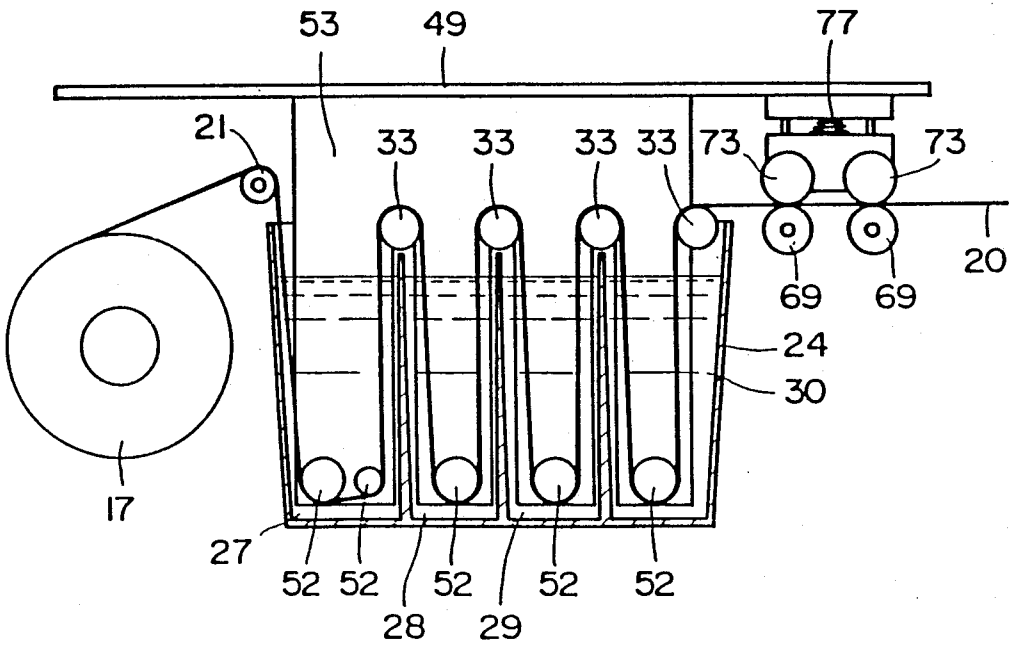
FIG. 6 is a schematic view showing movement of a film being processed.

After that, front cover 13 i closed and upper cover 49 is pushed down, looking knobs 57 are used to engage locking claws 56 with casing 12 to fix upper cover 49 to the casing 12. As shown in FIG. 6 which shows the condition at this time, processing rollers 52 are pressed against the leader of film 20 as upper cover 49 is moved down and, in this condition, go into the processing solution tank 24. As a result, film 20 is alternately wound around processing rollers 52 and direction change rollers 33 and, in a zigzag direction, immersed in developing solution 27, fixing solution 28, and washing liquids 29 and 30. Holding squeeze rollers **73*a* and 73*b* are pressed against fixed squeeze rollers 69*a* and 69*b* to pinch film 20 with the force of pressing spring 77 associated with the moving-down of upper cover 49**.

When a start switch 83 (FIG. 2) is turned on, developing heater 38 and drying heater 63 are energized, and stirring motor 46 and fan motor 61 operate to stir developing solution 27 and Washing liquids 29 and 30 and blow out constant-temperature hot air from hot air blowing port 62. When liquid temperature sensor 40 detects that the temperature of developing solution 27 has reached a predetermined value, film feed motor 64 begins to operate. This causes film 20 to be processed by developing, fixing, and rinsing with water. Then, before film 20 is carried o the drying process, it passes between water repellent squeeze rollers 95 and hydrophilic squeeze rollers 96 at the film-inlet side to efficiently remove water from the surface of the film. Then film 20 is dried as it passes in front of hot air blowing port 62, and is wound around winding reel 67. When film sensor 22 detects that film 20 is fed out, all power is turned off after of a predetermined period of time has passed. The front cover 13 is opened and processed film 20 which has been wound around winding reel 67 is removed. At this time, developing solution 27, fixing solution 28, and/or washing liquids 29 and 30 maybe changed or disposed of as needed.

As described above, in the film processing device according to the present invention, feed unit A. processing unit B. and drying/winding unit C are structured and assembled independently of each other, and each unit has no dependent relation to the other units. Thus, as shown in FIG. 1, each unit can be independently removed from casing 12 and can be independently assembled into the casing.

Therefore, in the assembly work, feed unit A. processing unit B, and drying/winding unit C can be assembled independently and then incorporated into the casing using very simple procedures.

Furthermore, when maintenance work is being performed, only the necessary part need be removed and repaired. For example, when a malfunction occurs in fan motor 61, only drying/winding unit C is removed, and it is not necessary to remove feed unit A or processing unit B. Similarly, only processing unit B must be removed when the processing liquids are changed.

This embodiment is an application of the present invention to a portable unit. However the present invention is not restricted to this. For example, the present invention can also be applied to a large-sized, fixed type device.

Next, a second embodiment of the present invention will now be described in detail with reference to the drawings.

FIGS. 7 to 15 are schematics showing the second embodiment.

The same structure and components used in the first embodiment shown in FIGS. 1 to 6 are indicated using the same reference numbers, and the same description thereof will not be repeated.

Figure 7:
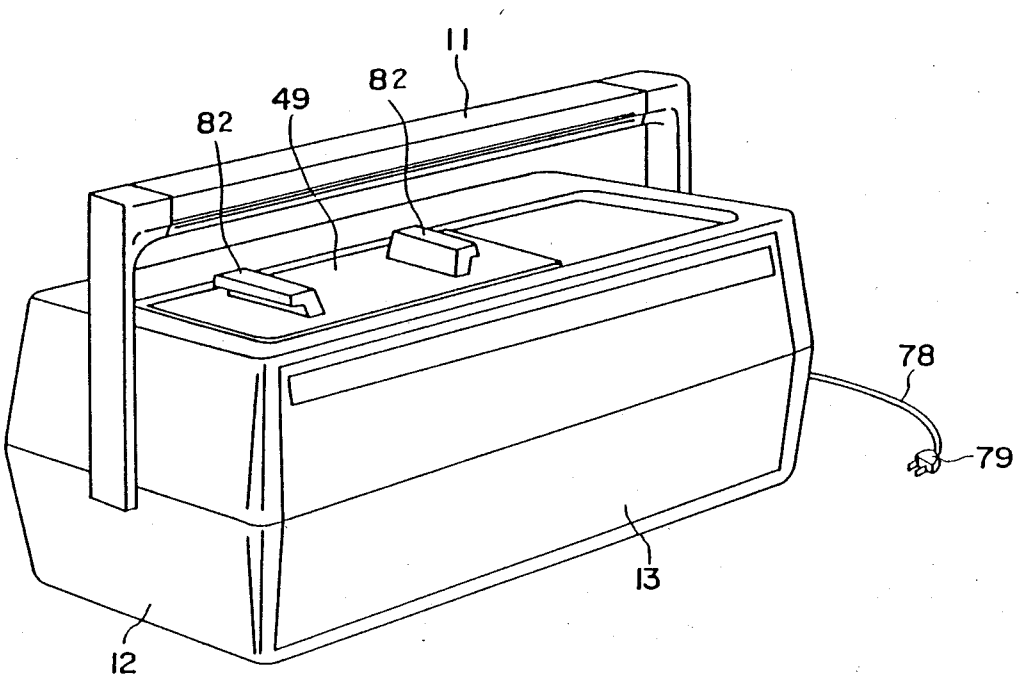
FIG. 7 is a schematic oblique view showing a second embodiment of the film processing device according to the present invention.
Figure 8:
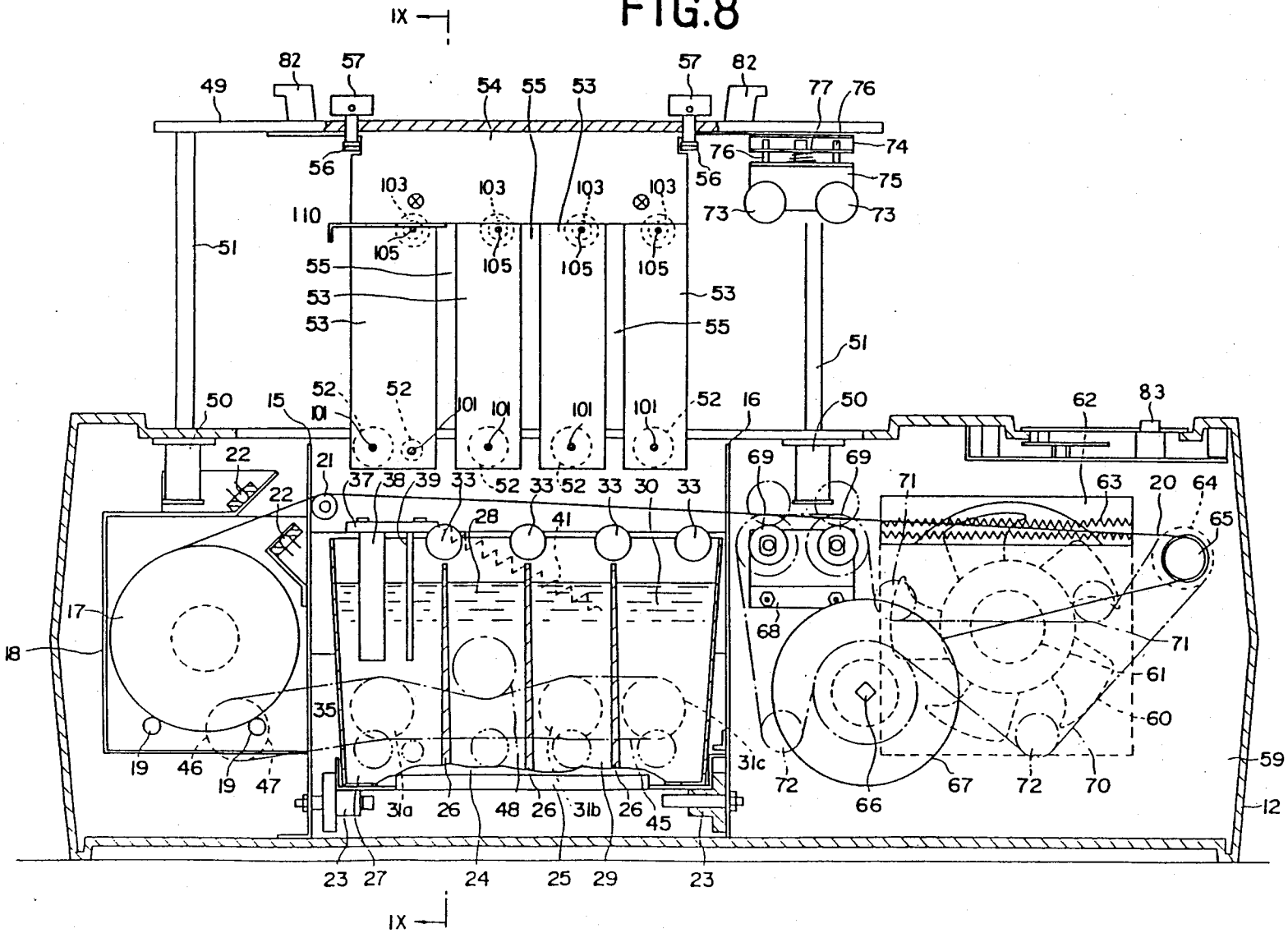
FIG. 8 is a schematic view showing internal structure of the film processing device shown in FIG. 7.

The second embodiment will first be described by referring to FIG. 7, which is a schematic outer view of the embodiment. FIG. 8, which is a schematic view showing the inside structure of the embodiment, and FIG. 9, which is a schematic sectional view taken along line IX—IX in FIG. 8.

At the front of a casing 12 rotatably mounted with a carrying handle 11, a front cover 13 which is openable to the front is mounted using hinges 14. Casing 12 is also provided with two partition frames 15 and 16 which divide the inside of casing 12 into three sections. A light shielding case 18, which contains a feed reel 17, is mounted on the first partition frame 15. A pair of reel receiving rollers 19 to rotatably support the feed reel 17 are rotatably disposed in the light shielding case 18. An exposed film 20 is wound around feed reel 17. A fixed guide roller 21 is rotatably disposed at the top of partition frame 15 and a pair of photoelectric film sensors 22 which detect the presence of exposed film 20 are disposed between fixed guide roller 21 and feed reel 17.

Figures 9, 10:
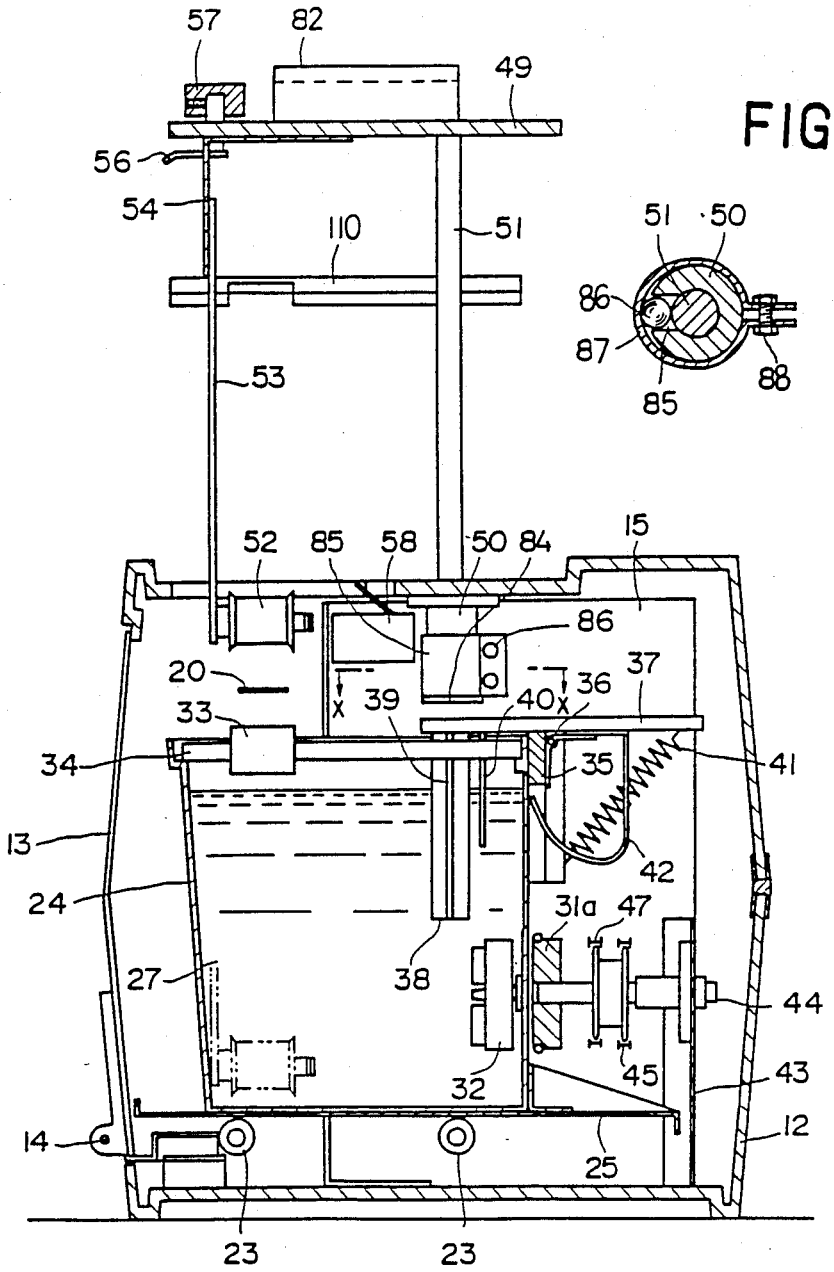
FIG. 9 is a schematic sectional view taken along line IX—IX of FIG. 8.
FIG. 10 is a schematic sectional view taken along line X—X of FIG. 9

As shown in FIG. 9, two pairs of front and rear receiving tray guide rollers 23 are rotatably mounted on opposing surfaces of partition frames 15 and 16. A receiving tray 25, on which a processing solution tank 24 is detachably disposed, is detachably placed on receiving tray guide rollers 23. The inside of processing solution tank 24 is divided into our sections by three partition walls 26, in which a developing solution 27, a fixing solution 28, a first washing liquid 29, and a second washing liquid 30 are respectively stored. In this embodiment, stirring impellers 32 are rotatably mounted on the respective sections of processing tank 24 where developing solution 27 and washing liquids 29 and 30 are respectively stored, to stir developing solution, 27 and washing liquids 29 and 30. The section storing fixing solution 28 may also be provided with a stirring impeller 32. Thus, stirring impellers 32 can be provided in all sections which require stirring. Front and rear ends of supporting shafts 34 for rotatably supporting four direction-changing rollers 33 are supported on the top of the processing solution tank 24.

A beam 35 having both ends thereof connected to partition frames 15 and 16 is disposed at the rear of processing solution tank 24. At the front end of a swing holder 37 which is rotatably mounted on beam 35 through a hinge 36, a rod-shaped developing heater 38 for heating developing solution 27, a liquid temperature sensor 39 for detecting the temperature of developing solution 27, and a liquid level sensor 40 which electrically detects whether or not the surface of developing solution 27 is above a predetermined level are respectively projected downward. At the rear en of swing holder 37 is connected one end of spring 41 which has a spring force to move up the front end of swing holder 37 about hinge 36 and to withdraw developing heater 38, liquid temperature sensor 39, and liquid level sensor 40 with respect to the processing solution tank 24, and the other end of spring 41 is fixed to beam 35. Furthermore, a contact plate 42 comprising a plate spring, of which the front end is in contact against the rear end of processing solution tank 24 to turn the front end of the swing holder 37 to the front around hinge 36 and to dip the lower portions of developing heater 38, liquid temperature sensor 39, and liquid level sensor 40 in the developing solution 27, is connected to swing holder 37 so that its rear end is positioned at the rear side of hinge 36.

The spring force of contact plate 42 is set to be greater than that of spring 11 in the state shown in FIG. 3. Therefore, when he processing solution tank 24 is pressed against contact plate 42, the front side of swing holder 37 is pushed down by contact plate 42. When processing solution tank 24 is pulled to the front, the front end of contact plate 42 is set free and the front side of swing holder 37 is moved up by the force of spring 41.

The three magnetic stirrers **31*a*, 31*b*, and 31*c*, which respectively are disposed in the vicinity of processing solution tank 24 and opposite to stirring impellers 32 at the inside rear of casing 12, are rotatably supported through supported shafts 44 by a stirrer supporting beam 43 disposed between partition frames 15 and 16. An endless chain 45 is provided between the supporting shaft 44 of magnetic stirrer 31*a* for developing solution 27 and the supporting shaft 44 of magnetic stirrer 31*c* for second washing liquid 30. An endless driving chain 47 is provided between the supporting shaft 44 of magnetic stirrer 31*a* for developing solution 27 and a spindle (not shown) of a stirring motor 46 provided at the rear of light shielding case 18 of feed reel 17. A tension sprocket 48 for engaging chain 45 with the supporting shaft 34 of magnetic stirrer 31*b* for first washing liquid 29 is disposed between the magnetic stirrers 31*a* and 31*b*. Therefore when stirring motor 46 is operated, magnetic stirrers 31*a*, 31*b*, and 31*c* are rotated in the same direction and, in turn, the stirring impellers 32 incorporated in processing solution tank 24 are rotated by a magnetic force, to stir developing solution 27 and washing liquids 29 and 30**.

On top of casing 12 is provided an upper cover 49 which is openable upward. Upper cove 49 is provided with a pair of guide bars 51 projected downward, which slidably penetrate vertically with friction through a pair of guide tubes 50 opposedly fixed through partition frames 15 and 16 at the top end of casing 12, and stoppers 84 (FIG. 9) are provided at tee lower ends of guide bars 51 to prevent the bars from coming out. As shown in FIG. 10 showing an enlarged view taken along line X—X in FIG. 9, guide tubes 50 are provided with steel ball containing holes 85 which communicate the inner peripheral surface With the outer peripheral surface. Steel ball containing holes 85 contain steel balls 86 which are pressed against guide bars 51. Steel ball holders 87 comprising plate springs are provided on the outer peripheral surfaces of guide tubes 50, which are retained on guide tubes 50 with retaining bolts 88.

Thus, by adjusting the driving amounts of the retaining bolts 88, pressing force of the steel balls 86 to the guide bars 51 can be varied and the upper cover 49 can be stopped at a desired vertical position. Furthermore, it is also effective to form steel ball engaging recesses which can engage with steel balls 86 on the outer peripheral surfaces of guide bars 51 according to the ascending end of upper cover 49 so that steel balls 86 engage with the steel ball engaging recesses to positively stop upper cover 49 at its ascending end. In this embodiment, upper cover 49 is manually moved up and down. However, it is naturally possible to provide racks on the guide bars 51, which are connected with a motordriven worm reduction mechanism with a pinion engaging with the racks, so that the motor is operated to automatically move upper cover 49 up and down.

At the front end of upper cover 49, a roller rack 53 provided with rotatable processing rollers 52 which are dipped respectively in developing solution 27, fixing solution 28, and washing liquids 29 and 30 protrudes downward through a rack bracket 54.

Figure 12:
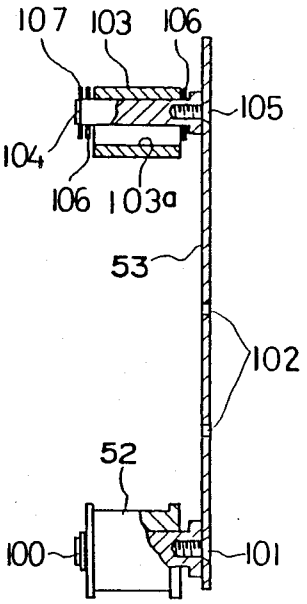
FIG. 12 is a schematic sectional view taken along line XII—XII of FIG. 11, FIG. 13 and FIG. 14 are schematic views showing squeeze rollers.
Figure 11:
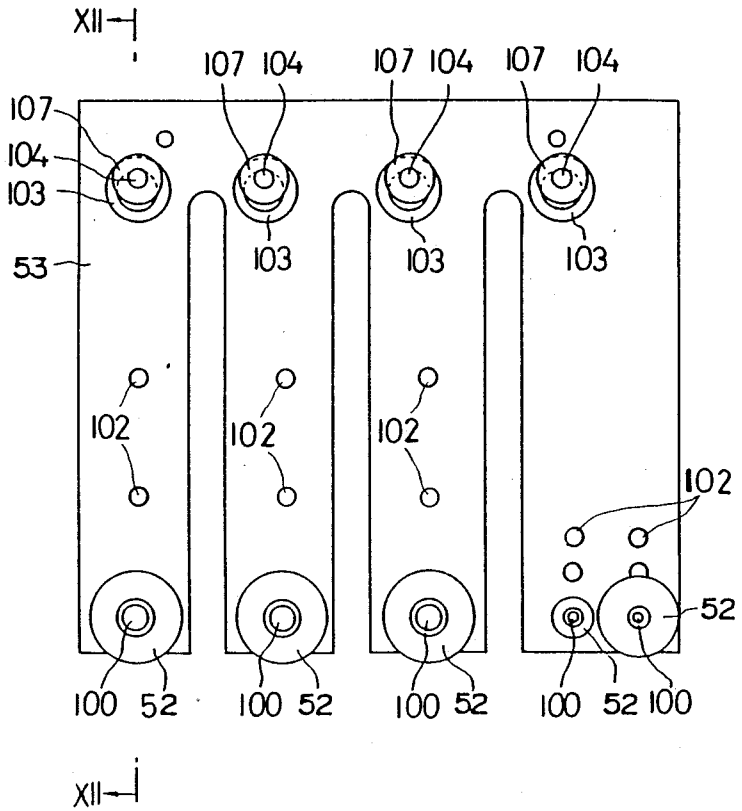
FIG. 11 is a schematic rear view of a roller rack.

Referring to FIG. 11 showing a rear view of roller rack 53 and FIG. 12 showing a sectional view taken along line XII—XII in FIG. 11, roller rack 53 is provided with roller mounting holes 102 with predetermined spacings according to the individual processing rollers 52 to retain rotary shafts 100 of the processing rollers 52 with screws 101. In this embodiment, the processing rollers 52 are mounted at the lowermost roller mounting holes. This allows the mounting positions of the processing rollers to be adjusted vertically. However roller adjusting means other than that used in this embodiment may be used. For example, roller mounting holes can be formed as vertical slots to allow adjustment of the vertical positions of the processing rollers with respect to the roller rack.

On roller rack 53, processing rollers 52 are retained by fastening their rotary shafts 100 using screws 101, and squeeze rollers 103 are retained by fastening pins 104, which rotatably support squeeze rollers 103, with screws 105.

Figure 14:
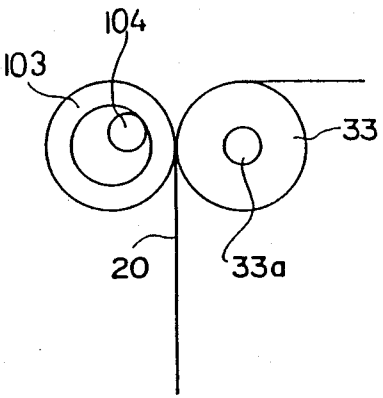
Figure 13:
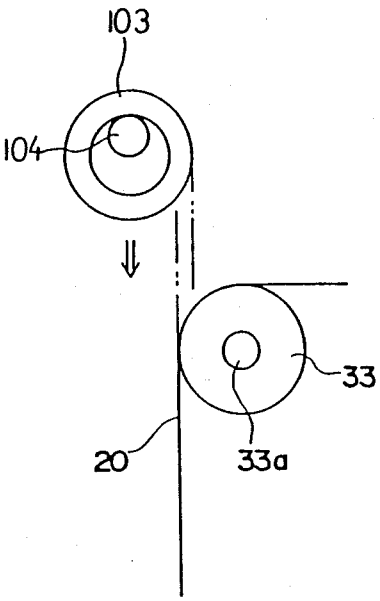

The squeeze roller 103, as shown in FIG. 11 and FIG. 12 showing its detailed structure, is a cylindrical roller having a pin through-hole 103*a* with a greater diameter than a pin 104, and is rotatably supported by pin 104 which is adjustable in the radial direction. Washers 106 having a diameter larger than that of pin through-hole 103*a* are disposed at both sides of squeeze roller 103. A snap ring 107 is disposed at the front end of pin 104 to prevent washers 106 and squeeze roller 103 from coming out. The horizontal position of pin 104 is at the upstream side with respect to the film feed direction of rotary shaft 100 of processing roller 52. When squeeze roller 52 is moved down by roller rack 53, squeeze roller 103 comes into contact with the upstream side surface of the direction-changing roller 33 as shown in FIG. 14. That is, the outer periphery of squeeze roller 103 and the outer periphery of direction-changing roller 33 overlap each other. This allows squeeze roller 103 in the upstream-dislocated state to come into contact with direction-changing roller 33 through film 20. Therefore, since squeeze roller 103 is in contact with film 20 with its own weight. squeeze roller 103 rotatingly contacts against film 20 as the film is fed, and processing solutions remaining on the surface of film 20 can be effectively removed.

In this embodiment, vertical position of the pin 104 supporting squeeze roller 103 is slightly above the rotary shaft 33*a* of direction-changing roller 33 when the roller rack 53 is moved down. For good rolling contact of squeeze roller 103 with film 20, it is desirable that the vertical position of pin 104 is the same as or above that of rotary shaft 33*a* of direction-changing roller 33. However, if the vertical position of pin 104 is below rotary shaft 33*a*, when the outer periphery of squeeze roller 103 an the horizontal position of the outer periphery of direction-changing roller 33 overlap each other. squeeze roller 103 can contact with film 20 which is fed in substantially the vertical direction to remove processing solutions from the surface of the film. When the feed path of the film is inclined, the squeeze roller of the above configuration can be arranged so that the roller is in rolling contact by its own weight with the upper surface of the film to remove processing solutions from the surface of the film.

In this embodiment, when pin 104 which supports squeeze roller 103 is positioned just above the rotary shaft 33*a* of direction-changing roller 33, processing solutions on the surface of film 20 can be removed. Depending on the feed speed of the film 20, however, the weight of only squeeze roller 103 may be insufficient, and removed processing solutions may not be smoothly returned to the processing solution tank.

In this embodiment, pin through-hole 103*a* of squeeze roller 103 has about twice the diameter of pin 104, and the squeeze roller 103 can be formed from acrylonitrilebutadiene-styrene copolymer (ABS resin) or hard rubber as for the case of direction-changing roller 33. Thus, in the embodiment, the diameter of pin through-hole 103*a* of squeeze roller 103 is substantially greater than the diameter of pin 104, which allows smooth functioning of squeeze roller 103 even when deposits from the processing solutions build up on pin 104.

Furthermore, in this embodiment. squeeze rollers 103 are disposed on vertically movable roller rack 53 and thus are movable vertically. However. squeeze rollers 103 can alternatively be disposed fixedly depending on the arrangement of the film processing device. When squeeze rollers 103 are fixedly disposed. squeeze rollers 103 are in contact with the opposing rollers with the force of their own weight and it is also possible to automatically load a film roll with a lead tape.

Roller rack 53 is provided with three vertical notches to prevent interference with partition walls 26 of the processing solution tank 24.

In this embodiment, as shown in FIG. 9, at the top of roller rack 53, a vaporization prevention plate 110 is integrally provided which covers the section of the processing solution tank 24 where developing solution 27 is stored, to prevent water in the developing solution 27 from vaporizing due to heating by developing heater 38. Since, in conventional art devices, a float is put on the surface of developing solution 27, crystals of the developing agent deposit on the peripheral surface of the float, and periodic cleaning of the float is required. In this embodiment, on the other hand, since vaporization prevention plate 110 is disposed above the surface of developing solution 27, such a problem does not occur.

A pair of locking knobs 57 each having a locking claw 56 to retain upper cover 49 onto casing 12 when the upper cover 49 is moved down are rotatably attached to upper cover 49 on both sides of rack brackets 54. Whether or not upper cover 49 is securely retained on casing 12 is detected by a touch sensor 58 mounted on top of casing 12.

The section of casing 12 at the opposite side of processing solution tank 24 partitioned by partition frame 16 is provided with a partition wall 59 which partitions this section into front and rear portions. A fan motor 61 having a blowing fan 60 to dry the processed film 20 is disposed at the rear of partition wall 59. Air from blowing fan 60 generated by the operation of fan motor 61 is blown from a hot air blowing port 62 formed in partition wall 59 in the direction parallel to the surface of film 20. A drying heater 63 is provided between hot air blowing port 62 and blowing fan 60 to shorten the drying time of film 20.

Referring to FIG. 8, a film drive roller 65 connected to a film feed motor 64 is rotatably mounted at the upper right end of partition wall 59. Similarly, a winding shaft 66 is rotatably provided at the lower left end of partition wall 59, and a winding reel 67 for Winding the dried film 20 is detachably mounted on winding shaft 66.

Two fixed squeeze rollers (right and left) 69 attached rotatably to partition wall 59 are disposed above winding shaft 66 using a bracket 68. An endless synchronizing chain 70 is provided on fixed squeeze rollers 69, film drive roller 65, and winding shaft 66. In this embodiment, a pair of withdrawing sprockets 71 are disposed between fixed squeeze rollers 69 and film drive roller 65. Winding sprockets 72 are disposed at the right and left of winding shaft 66 and are rotatably attached to partition wall 59. Withdrawing sprockets 71 and winding sprockets 72 engage with synchronizing chain 70.

Film drive motor 64 rotates fixed squeeze rollers 69, film drive roller 65 and Winding shaft 66 in synchronization. These drive mechanisms are all disposed at the rear side of partition wall 59.

In this embodiment, two holding squeeze rollers 73 (right and left) which cooperate with the fixed squeeze rollers 69 to wipe off water drops from the processed film 20 are rotatably supported on a roller holder 75 hung down from upper cover 49 through a roller bracket 74. Stopping pins 76 engage with grooves (not shown) provided in the roller bracket 74 to hold the rotational axes of the fixed squeeze rollers 69 parallel to the rotational axes of holding squeeze rollers 73*a* and 73*b*. A pressing spring 77 urges the holding squeeze rollers 73 towards fixed squeeze rollers 69. Stopping pins 76 and pressing spring 77 are disposed between roller bracket 74 ad roller holder 75. Since, in this embodiment, holding squeeze rollers 73 are attached to upper cover 49, film 20 can be inserted between fixed squeeze rollers 69 and holding squeeze rollers 73 when the upper cover is lifted up. This provides improved workability over a conventional ar contact type in Which holding squeeze rollers are attached to the casing.

In actual operation, the entire device is first placed on a table or the like, a power cord 78 wound around a cord reel 80 which is disposed at the rear of casing 12 is unrolled, and a plug 79 at the end of the power cord is connected to a power outlet in the room.

The front cover 13 is opened and locking knobs 57 are turned to unlock locking claws 56 from casing 12 and processing rollers 52 and upper cover 49 are lifted up to a location above the processing solution tank 24 by gripping a handle 82 provided on upper cover 49 (FIG. 8 and FIG. 9). Then the processing solution tank 24 and receiving tray 25 are pulled out to the front. At this time, in the course of pulling out the receiving tray, the front end of contact plate 42 becomes free, and swing holder 37 is turned about hinge 36 by the force of spring 41 to withdraw developing heater 38, liquid temperature sensor 39, and liquid level sensor 40 to a point above the processing solution tank 24. Predetermined sections of the processing solution tank 24, which has been pulled out to the front of casing 12, are respectively charged with predetermined quantities of developing solution 27, fixing solution 28, and washing liquids 29 and 30, and then the processing solution tank 24 and the receiving tray 25 are returned to their original position in casing 12. At this time, the front end of contact plate 42 comes into contact with the processing solution tank 24, the swing holder 37 is turned against the force of spring 41, and developing heater 38, liquid temperature sensor 39, and liquid level sensor 40 are dipped in developing solution 27 (FIG. 8 and FIG. 9).

Next, a cover (not shown) of light shielding case 18 is opened and feed reel 17 around which undeveloped film 20 is wound is placed on reel receiving roller 19 in the light shielding case 18. The cover of light shielding case 18 is then closed with the leader portion of the film 20 being unrolled. The front end of the leader of film 20 is routed from fixed guide roller 21, through the processing solution tank 24 and fixed squeeze rollers 69 and through the front of hot air blowing port 62, wound around film drive roller 65, and fixed to winding reel 67 mounted on winding shaft 66 (FIG. 8).

Figure 15:
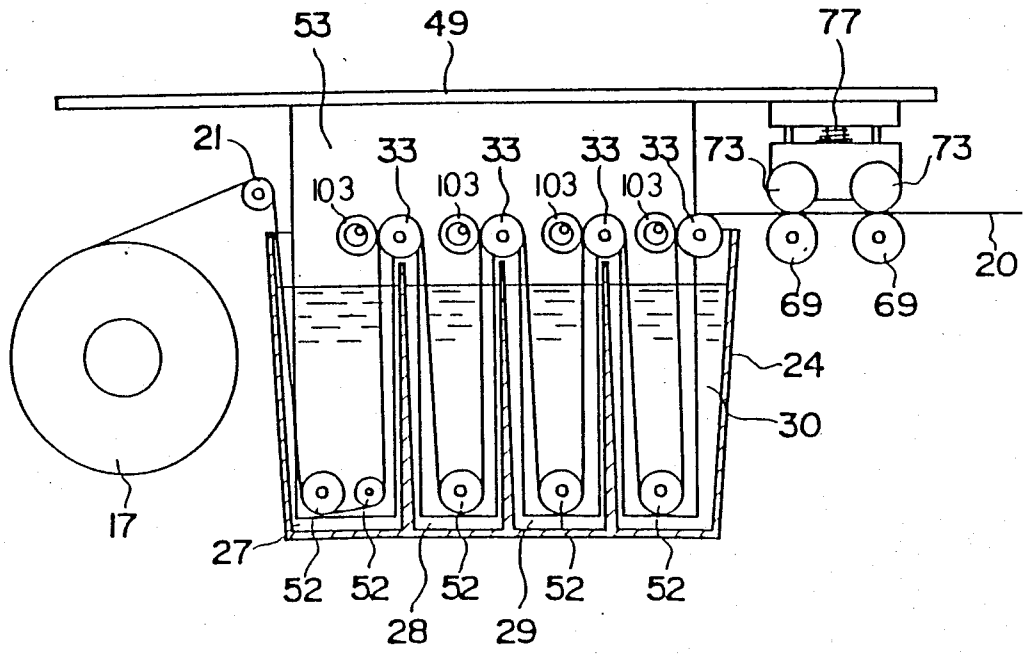
FIG. 15 is a schematic view showing movement of a film being processed.

After that, front cover 13 is closed and upper cover 49 is pushed down, locking knobs 57 are operated to engage the locking class 56 with casing 12 to fix upper cover 49 to casing 12. As shown in FIG. 15 which shows the condition at this time the processing rollers 52 are pressed against the leader of film 20 as upper cover 49 is moving down and, in this condition, go into the processing solution tank 24. As a result, film 20 is alternately wound around processing rollers 52 and direction change rollers 33 and, in a zigzag direction, immersed in developing solution 27, fixing solution 28, and washing liquids 29 and 30. Holding squeeze rollers 73 opposing the fixed squeeze rollers 69 are pressed against fixed squeeze rollers 69 pinching film 20 wit the force of pressing spring 77 associated with the moving-down of upper cover 49.

When a start switch 83 is turned on, developing heater 38 and drying heater 63 are energized, and stirring motor 46 and fan motor 61 operate to stir developing solution 27 and washing liquids 29 and 30 and to blow out constant-temperature hot air from hot air blowing port 62, respectively.

This embodiment allows efficient stirring operation since the roller rack 53 which disturbs stirring of the processing solutions is not disposed between the stirring impellers 32 and the processing rollers 52.

When liquid temperature sensor 40 detects that the temperature of developing solution 27 reaches a predetermined value, film feed motor 64 begins to operate. This causes film 20 to be processed by developing fixing, and rinsing with water. Then, water drops are removed from the surface of film 20 by the two sets of squeeze rollers 69 and 73, dried as it passes in front of hot air blowing port 62, and then wound around winding reel 67. When film sensor 2 detects that film 20 is fed out, all power is turned off after the passage of a predetermined period of time has passed, front cover 13 is opened and winding reel 67 around which processed film 20 is wound is removed. At this time, developing solution 27, fixing solution 28, and/or washing liquids 29 and 30 may be changed or disposed of as needed.

What is claimed:

1. A film processing device comprising a plurality of independently constructed modules and a support for supporting said modules to form said device, comprising:

a first module comprising a feed unit containing a feed reel around which undeveloped film is wound in a light-shielded state;

a second module comprising a developing unit for storing and stirring a heated developing solution, a fixing solution, and washing liquids nd for feeding said film into said solutions and liquids using a plurality of rollers; and a third module comprising a drying unit for drying said film by blowing hot air from a hot air blowing port and a winding unit for winding said dried film around a winding reel which is disposed near said hot air blowing port of said drying unit.

2. The film processing device as claimed in claim 1, further comprising at least two pairs of opposed squeeze rollers disposed between said developing unit and said drying unit for pinching said said film, an upstream pair of said squeeze rollers being water-repellent squeeze rollers having surfaces formed from a water-repellent material, and a downstream pair of said squeeze rollers being hydrophilic squeeze rollers having surfaces formed from a hydrophilic material, each one of said water-repellent squeeze rollers and each one of said hydrophilic squeeze rollers being driven in the feed direction of said film to remove water from the surface of said film.

3. A film processing device comprising:

a casing;

a feed unit within said casing containing a feed reel around which undeveloped film is wound in a light-shielded state:

a developing unit within said casing having a processing solution tank means containing at least a developing solution, a fixing solution, and washing liquids, at least three processing rollers immersed respectively in said developing solution, said fixing solution, and said washing liquids, and at least two direction-changing rollers disposed above said processing solution tank means and between adjacent processing rollers for alternately routing an exposed film over said processing rollers:

a drying unit within said casing for drying said film by blowing hot air; and a winding unit within said casing for winding the dried film around a winding reel; and an upper cover attached to and vertically movable with respect to said casing, said cover having a roller rack protruding downward from said upper cover and having said processing rollers rotatably attached to its bottom end;

wherein said upper cover may be set so that said processing rollers are positioned above said directionchanging rollers.

4. The film processing device as claimed in claim 3, further comprising means for changing vertical mounting positions of rotary shafts of said processing rollers with respect to said roller rack.

5. The film processing device as claimed in claim 3, further comprising squeeze rollers for removing processing solutions from said processed film, said squeeze rollers being cylindrical rollers having pin throughholes with diameters greater than pins for supporting said squeeze rollers and being supported movably against said film, and being in rolling contact with said film due to their own weight so that said film is fed between said squeeze rollers and said direction-changing rollers.

6. The film processing device as claimed in claim 5 further comprising means for preventing evaporation of at least water in said developing solution.

7. The film processing device as claimed in claim 5, wherein said pins for supporting said squeeze rollers are disposed at a vertical location of equal height or higher than a rotary shaft of said direction changing rollers.

* * * * *